United States Patent [19]

Cornelissen et al.

[11] Patent Number: 4,547,305

[45] Date of Patent: Oct. 15, 1985

[54] LOW TEMPERATURE BLEACHING DETERGENT COMPOSITIONS COMPRISING PERACIDS AND PERSALT ACTIVATOR

[75] Inventors: Johannes M. Cornelissen, Vlaardingen; Cornelis A. Lagerwaard, Hellevoetsluis; Rudolf J. Martens, Vlaardingen, all of Netherlands

[73] Assignee: Lever Brothers Company, New York, N.Y.

[21] Appl. No.: 513,555

[22] Filed: Jul. 14, 1983

[30] Foreign Application Priority Data

Jul. 22, 1982 [GB] United Kingdom ..... 8221230

[51] Int. Cl.[4] ..... C11D 3/395; C11D 7/18; C11D 7/54; D06L 3/00

[52] U.S. Cl. ..... 252/94; 252/95; 252/96; 252/99; 252/186.31; 252/186.38

[58] Field of Search ..... 252/95, 99, 96, 186.31, 252/186.38, 94

[56] References Cited

U.S. PATENT DOCUMENTS

| | | | |
|---|---|---|---|
| 3,822,114 | 7/1975 | Montgomery | 252/99 |
| 3,969,257 | 7/1976 | Murray | 252/99 |
| 4,021,361 | 5/1977 | Lee | 252/99 |
| 4,064,062 | 12/1977 | Yurko | 252/186.31 |
| 4,107,065 | 8/1978 | Gray | 252/99 |
| 4,189,396 | 5/1978 | Brace et al. | 252/99 |
| 4,325,828 | 4/1982 | Postlethwaite | 252/99 |
| 4,430,244 | 2/1984 | Broze et al. | 252/186.38 |

FOREIGN PATENT DOCUMENTS

| | | |
|---|---|---|
| 0027693 | 4/1981 | European Pat. Off. . |
| 0051987 | 5/1982 | European Pat. Off. . |
| 0058444 | 8/1982 | European Pat. Off. . |
| 1392284 | 4/1975 | United Kingdom . |

*Primary Examiner*—John E. Kittle
*Assistant Examiner*—Mukund J. Shah
*Attorney, Agent, or Firm*—Milton L. Honig; James J. Farrell

[57] ABSTRACT

Detergent compositions, particularly low temperature bleach detergent compositions comprising an inorganic persalt and an organic peracid precursor (persalt activator) or an organic peracid in lieu thereof, containing less than 10 mg/kg, preferably not more than 5 mg/kg of reactive titanium (IV), based on the total weight of the composition, are disclosed. These compositions show improved peracid stability, thereby improving the peracid concentration during the washing and cleaning operation to give enhanced bleaching results. The detergent compositions preferably contain a silicate.

13 Claims, 1 Drawing Figure

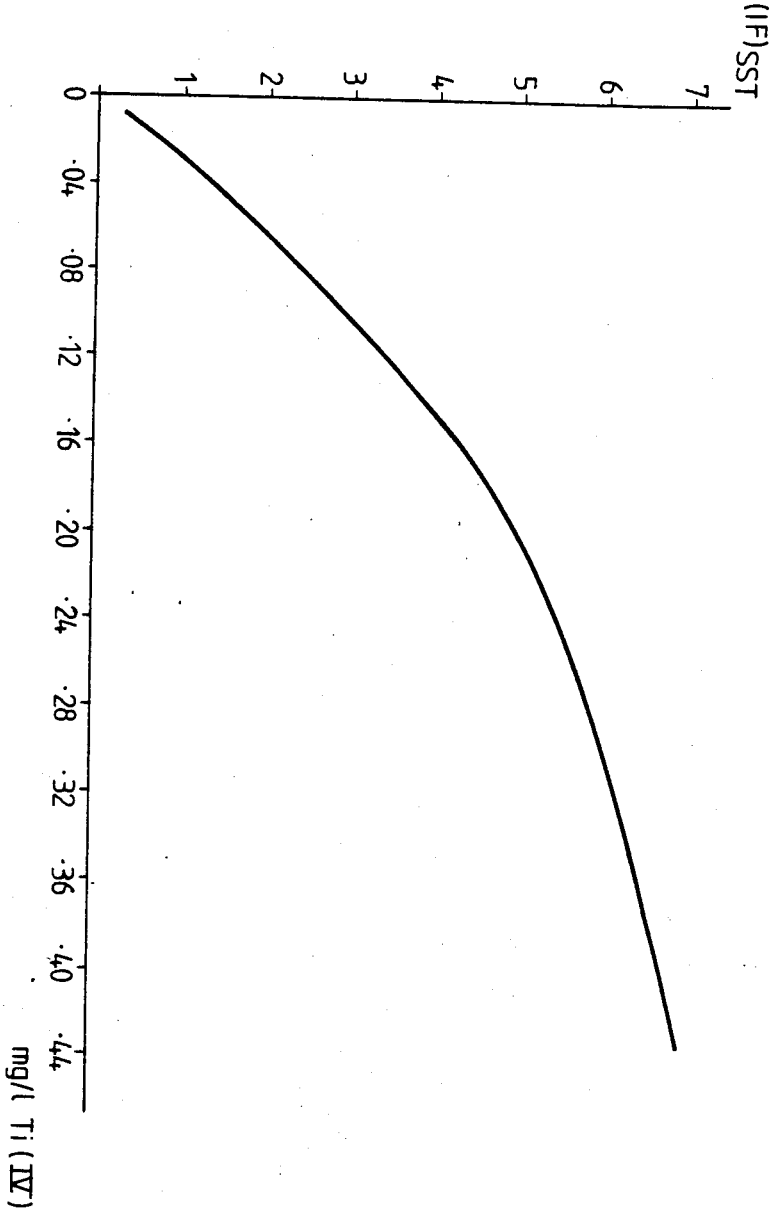
(IF)SST
7
6
5
4
3
2
1
0
·04
·08
·12
·16
·20
·24
·28
·32
·36
·40
·44
mg/l Ti (IV)

LOW TEMPERATURE BLEACHING DETERGENT COMPOSITIONS COMPRISING PERACIDS AND PERSALT ACTIVATOR

This invention relates to detergent compositions, and in particular to so-called low temperature bleaching detergent compositions comprising organic peracids or of the type functioning by the generation, during use, of organic peracids, for example peracetic acid. The latter compositions essentially comprise an inorganic persalt and an organic compound which can react at relatively low temperatures, for example at 20°-60° C., with the persalt, or with hydrogen peroxide liberated by the persalt, to form organic peracids. Such organic compounds, of which many representatives are known in the art, are hereinafter termed "organic peracid precursors" or "persalt activators".

Normally such compositions also comprise a sequestering agent effective for chelating heavy metal ions as a stabilizer for the persalt and the peracid in solution, such as ethylene diamine tetra acetic acid (EDTA), ethylene diamine tetra methylene phosphonic acid (EDTMP), diethylene triamine penta methylene phosphonic acid (DTPMP), hydroxyethane-1,1-diphosphonic acid (EHDP) and the alkali metal or earth alkaline metal salts of such acids. Generally a mixture of EDTA and any of the polyphosphonic acids is used.

In the formulation of low temperature bleaching detergent compositions, however; some inconsistency occurs in the stability of the peracid system in solution, in spite of the presence of stabilizing agents. Since reduced peracid stability is inherent to a reduced peracid concentration during the wash, the consequence thereof is a reduced bleach efficiency. In the course of further experiments it has been established that such peracid stability problems occur especially with formulations comprising a silicate. Silicate, particularly alkali metal silicate such as sodium silicate, is normally incorporated in detergent/cleaning compositions as a useful alkaline builder to provide the necessary alkaline pH for improved detergency/cleaning and peracid generation, and as anti-corrosion agent. Sodium silicate is also a useful ingredient as a structuring aid to powdered detergent compositions. The sodium silicates usable in such compositions normally have $SiO_2$:$Na_2O$ ratios of between 1.0 and 3.5. Another useful silicate in bleaching detergent compositions is magnesium silicate, which is generally incorporated as an additional stabilizer for persalts. The total silicate normally used in detergent/-cleaning compositions of the present type amounts to about 3-30% by weight of the total composition.

This phenonomenon of peracid destabilisation, which apparently is pH-detergent and dependent on the water-hardness of the solution, occurs and is not removed in spite of the presence of the most effective stabilising agents hitherto known for use in low temperature bleach compositions, e.g. ethylene diamine tetra methylene phosphonic acid or its salts. It has been observed that an increase in pH and/or water-hardness generally tends to magnify the peracid destabilising effect.

It has now been discovered that this reduction in peracid stability, causing a decrease in peracid concentration in the bleach solution with consequent reduction of bleach efficiency, is connected with titanium present in the low temperature bleaching detergent composition. This is quite surprising since titanium is not normally considered as belonging to the group of transition metals which are active in catalysing peroxide and peracid decomposition. Titanium may be introduced in the formulation from various sources, the most important of which are enzyme encapsulates and impurities in silicates, including aluminosilicates. Also phosphates and other detergent ingredients may contain titanium as impurities. Not all titanium present in the bleaching compositions was found to cause destablisation of peracid and a distinction is made between reactive titanium and non-reactive titanium.

Only reactive titanium, termed hereinafter reactive titanium (IV)—Ti(IV)—causes the problem, against which the currently known sequestering agents are substantially ineffective.

Reactive titanium (IV) in the formulation can be detected and its concentration can be measured by a standard analytical method, after removal of the non-reactive titanium by ultra-centrifugation.

The standard analytical technique for reactive titanium analysis used in this invention is the plasma emission spectroscopic method as described in "Chemical Analysis", Volume 46, Trace Analysis, Spectroscopic Methods for Elements, edited by J. D. Winefordner, John Wiley & Sons, 1976, Chapter 6, page 142 ff.

Although the use of excessively high proportions, in the order of a 25-50 mole ratio of a particular sequestering agent to titanium, may be able to mask to a certain extent the destabilising effect mentioned above, such a measure is unsatisfactory in terms of results, especially under hard water conditions and in terms of practicability and economy.

It is therefore an object of the invention to provide low temperature bleach detergent compositions comprising either an organic peracid or its precursor with very low to nil reactive titanium (IV) contents.

It has now been found that the stability of the peracid system can be greatly improved, thereby improving the peracid concentration during the washing and cleaning operation to a satisfactory degree, if the reactive titanium (IV) concentration in the detergent composition is below 10 mg/kg, preferably not more than 5 mg/kg, based on the total weight of the composition.

This is especially important for formulations containing high levels, e.g. about 15 to 50%, of soap functioning as detergency builder. In such high soap level formulations the concentration of reactive titanium (IV) should preferably not exceed 3 mg/kg, based on the total weight of the formulation.

The organic peracid in the wash system may be generated in situ from a reaction of an inorganic persalt and an organic peracid precursor present in the composition or may be introduced as such. In the latter case the detergent composition comprises an organic peracid instead of its precursor.

Accordingly, in one embodiment of the invention a detergent composition comprises an inorganic persalt and an organic peracid precursor, which composition is characterized in that it contains less than 10 mg/kg, preferably not more than 5 mg/kg, of reactive titanium (IV), based on the total weight of the composition.

In another embodiment of the invention a detergent composition comprises an organic peracid, which composition is characterized in that it contains less than 10 mg/kg, preferably not more than 5 mg/kg, of reactive titanium (IV), based on the total weight of the composition.

Usually and preferably the detergent composition of the invention also comprises a silicate, which may be present in the form of its alkalimetal salts, its magnesium salt or as aluminosilicates or mixtures thereof.

The peracid stability in the composition can be determined by a standard test, from which an "instability factor" (IF) of the composition can be calculated. This instability factor can be used to rank detergent compositions with respect to their peracid stability in use. IF=0.0 indicates an ideal situation of complete peracid stability. The higher the IF is, the less effective the bleach performance will be. The higher the pH and the higher the water hardness are, the higher the IF will be and the more important the elimination of Ti(IV) to the lowest possible minimum.

Standard test for determining the Instability Factor (IF)

A glass vessel provided with a vigorous stirrer (300–500 rpm) is used. Water is fed to the vessel and the product is dosed at 6 grams per liter. With vigorous stirring the contents of the vessel are heated from 20° to 60° C. in 25 minutes and thereafter held at this temperature for 30 minutes. The course of the total active oxygen content (present as peracid and hydrogen peroxide) and the peracid content [PA] was determined.

The instability factor is defined as:

$$IF = \frac{[O]_{t1} - [O]_{t2}}{[PA]_{max.}} \times \frac{100}{t2 - t1},$$

[O] denoting total active oxygen concentration, wherein t1 is the time at the observed $[PA]_{max.}$ and t2 is the time at which the [PA] becomes 40% of the input [PA].

Normally but not necessarily, the composition of the invention will contain a surfactant, especially if it is used for the laundering and bleaching of fabrics. The surfactant can be anionic soap or non-soap detergent, nonionic, cationic, semi-polar, ampholytic or zwitterionic in nature, or can be mixtures thereof, especially anionics, nonionics and cationics. Surfactants can be used at a level of from about 0.1% to about 60% by weight of the composition.

Preferred anionic non-soap surfactants are water-soluble salts of alkyl benzene sulphonate, alkyl sulphate, alkyl polyethoxy ether sulphate, paraffin sulphonate, alpha-sulphocarboxylates and their esters, alkyl glyceryl ether sulphonate, fatty acid monoglyceride sulphates and sulphonates, alkyl phenol polyethoxy ether sulphate, 2-acyloxy alkane-1-sulphonate, and betaalkyloxy alkane sulphonate. Soaps are also preferred anionic surfactants.

Especially preferred are alkyl benzene sulphonates with about 9 to about 15 carbon atoms in a linear or branched alkyl chain, more especially about 11 to about 13 carbon atoms; alkyl sulphates with about 8 to about 22 carbon atoms in the alkyl chain, more especially from about 12 to about 18 carbon atoms; alkyl polyethoxy ether sulphates with about 10 to about 18 carbon atoms in the alkyl chain and an average of about 1 to about 12 —$CH_2CH_2O$—groups per molecule, especially about 10 to about 16 carbon atoms in the alkyl chain and an average of about 1 to about 6 —$CH_2CH_2O$—groups per molecule; linear paraffin sulphonates with about 8 to about 24 carbon atoms, more especially from about 14 to about 18 carbon atoms; and alpha-olefin sulphonates with about 10 to about 24 carbon atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium cations under certain circumstances may also be used.

Preferred nonionic surfactants are water-soluble compounds produced by the condensation of ethylene oxide and/or propylene oxide with a hydrophobic compound such as a long-chain alcohol, alkyl phenol, polypropoxy glycol, or polypropoxy ethylene diamine.

Especially preferred polyethoxy alcohols are the condensation products of 1 to 30 moles of ethylene oxide with 1 mol of branched or straight chain primary or secondary aliphatic alcohol having from about 8 to about 22 carbon atoms; more especially from 1 to 6 moles of ethylene oxide condensed with 1 mol of straight or branched chain primary or secondary aliphatic alcohol having from about 10 to about 16 carbon atoms; certain species of polyethoxy alcohols are commercially available from the Shell Chemical Company under the trade names "Neodol" and "Dobanol".

Preferred cationic surfactants are cationic softeners. Suitable cationic surfactants include the conventional quaternary ammonium compounds and $C_{10}$–$C_{25}$ alkyl imidazolinium salts. Preferred quaternary ammonium softeners are the di($C_{16}$–$C_{20}$ alkyl) di($C_1$–$C_4$ alkyl) ammonium salts such as ditallow dimethyl ammonium chloride; ditallow dimethyl ammonium methylsulphate; di-hydrogenated tallow dimethyl ammonium chloride or methylsulphate; dioctadecyl dimethyl ammonium chloride; di-coconut alkyl dimethyl ammonium chloride. Also suitable are the single long chained quaternary ammonium compounds wherein the long chain is a $C_{10}$–$C_{22}$ alkyl or alkenyl group.

A preferred member of the class of $C_{10}$–$C_{25}$ alkyl imidazolinium salts, believed to be 1-methyl-2-tallow-3-(2-tallow amide ethyl) imidazolinium chloride, is sold under the trade name of Varisoft 455 or 457 (Ashland Chemical Company) or Steinoquat M5040/H (Chemische Werke Rewo).

A typical listing of the classes and species of surfactants useful in this invention appear in the books "Surface Active Agents", Vol. 1, by Schwarts & Perry (Interscience 1949) and "Surface Active Agents and Detergents", Vol. II by Schwartz, Perry and Berch (Interscience 1958), the disclosures of which are incorporated herein by reference. This listing, and the foregoing recitation of specific surfactant compounds and mixtures which can be used in the instant compositions, are representative but not intended to be limiting.

Furthermore, alkaline and detergency builders are usually added at levels up to about 80% by weight of the composition, preferably from 10% to 60% by weight. They may be inorganic or organic builders or mixtures thereof. Examples of alkaline and detergency builders are sodium and potassium triphosphates; sodium or potassium orthophosphates; sodium or potassium pyrophosphates; sodium carbonate or bicarbonate; various sodium borates, e.g. borax; nitrilotriacetic acid and its water-soluble salts; sodium ethylene diamine tetra acetate; carboxymethyloxymalonate; carboxymethyloxysuccinate; citrates; dipicolinic acids and the various insoluble aluminosilicate ion exchange materials such as Zeolite type A.

Further, alkaline components, fillers and the usual adjuncts, such as optical brighteners; soil-suspending agents and anti-redeposition agents such as sodium carboxy methyl cellulose, homo- and co-polymers of polycarboxylic acids, e.g. methyl vinyl ether/maleic anhydridecopolymers; sequestering agents; anti-oxidants; perfumes; colouring agents; and enzymes, particularly proteolytic and amylolytic enzymes, may be present.

The usual inorganic persalt is sodium perborate, which is used as the monohydrate or the tetra hydrate, but other inorganic persalts, for example percarbonates, perpyrophosphates and persilicates, may alternatively be used. These may not be true persalts in the strict sense but they are believed to contain hydrogen peroxide of crystallisation which is liberated in aqueous solution. The liberated hydrogen peroxide reacts with the organic peracid precursor to form the organic peracids.

The organic peracid precursors are typically organic compounds containing one or more acyl groups which are susceptible to perhydrolysis. Acetyl and benzoyl radicals are preferred, generating peracetic and perbenzoic acid, respectively.

Specific organic peracid precursors which may be mentioned by way of example are esters such as sodium acetoxy benzene sulphonate, chloroacetoxy salicylic acid, glucose penta acetate and xylose tetra acetate; acyl-substituted cyanurates such as triacetyl cyanurate; amides, particularly acetylated alkyl amines such as N,N,N',N'-tetra acetyl ethylene diamine (TAED) and N,N,N',N'-tetra acetyl methylene diamine; N-acetyl imidazole and N-benzoyl imidazole; N-acetyl caprolactam; acylated barbitones, hydantoins, glycolurils, such as N,N'-diacetyl barbitone, N,N'-diacetyl-5,5-dimethyl hydantoin and N,N,N',N'-tetra acetyl glycoluril. Many other organic peracid precursors are known and are described in the literature, for example in British Patent Specns. Nos. 836 988; 855 735 and 907 356; U.S. Patent Nos. 1 246 339; 3 332 882 and 4 128 494, and Canadian Patent Specn. No. 844 481.

The amount of inorganic persalt present in the composition of the invention may vary from about 2–35% by weight, preferably from 5–20% by weight.

The amount of peracid precursor used is generally lower and may be varied within a range of approx. 0.25 to 20% by weight, preferably from 0.5 to 10% by weight, based on the total composition, which can be used in any ratio by weight to the persalt within the range of from 1:0.5 to 1:30, preferably from 1:2 to 1:15.

As already explained earlier, the invention is also applicable to bleach compositions which contain an organic peracid incorporated as such.

The organic peracids which can be used in the present invention may be either aliphatic or aromatic and have the general formula:

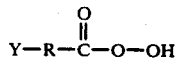

wherein R is an alkylene group containing from 1–16 carbon atoms or an arylene group containing from 6 to 8 carbon atoms and Y is hydrogen, halogen, alkyl, aryl or any group which provides an anionic moiety in aqueous solution, for example

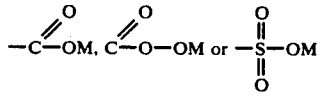

wherein M is hydrogen or a water-soluble salt-forming cation.

Examples of aliphatic peracids are peracetic acid, monoperazelaic acid, diperazelaic acid and diperadipic acid. Diperazelaic acid is preferred.

Examples of aromatic peracids are monoperphthalic acid, perbenzoic acid, m-chloro-perbenzoic acid and diperisophthalic acid. Monoperphthalic acid and diperisophthalic acid are preferred.

They may be used in the form of their acids or their water-soluble salts.

An especially preferred form and class of organic peracid usable in the present invention is magnesium monoperoxyphthalate as described in EPNo-A-0027.693.

The invention can be applied to solid or liquid compositions for all sorts of cleaning, particularly for cleaning fabrics, for general cleaning, and machine dishwashing.

The advantage of the present invention is that peroxide and peracid stability is greatly improved thereby, resulting in a better bleaching efficiency. Compositions of the invention having reactive titanium (IV) contents well below 5 mg/kg will have the additional advantage that the use of stabilising agents of the polyphosphonate type as described in British Pat. Specn. 1392 284 and U.S. Pat. Specn. No. 4 225 452, can be minimised or even omitted.

Since silicates are the major source of reactive titanium (IV), the concentration of which varies widely from one silicate to the other, the reactive titanium (IV) content of the silicate used should be carefully monitored in order to keep the Ti(IV) of the composition under control.

A convenient method has been devised for determining the instability factor (IF) of silicates. This instability factor correlates very well with the reactive titanium (IV) content of the silicate and can be used to select suitable silicates.

Standard procedure for the determination of the instability factor $(IF)_{SST}$ for sodium silicates

Apparatus

A thermostated glass vessel equipped with a mechanical glass stirrer (300–500 rev./min.), electrode for pH determination, and a thermometer. The temperature of the solution in the vessel is kept at 40° C.

Procedure

In 1 liter of 15° GH water (molar ratio Ca:Mg=4:1) 2.0 g (5.4 mmol) STP O aq (100% basis), 1.078 g (7.0 mmol) sodium perborate tetra-hydrate (100% basis) and 0.005 g (0.01 mmol) Dequest 2041 (100% basis) are dissolved at 40° C.

A solution of 0.456 g (2.0 mmol) TAED (100% basis) in 5–10 ml acetonitrile ($CH_3CN$) is added. Within 30 sec. the pH is adjusted at 40° C. with 3N NaOH to pH 10.5. After exactly 10 min. 0.9–1.4 g (based on 300 mg $SiO_2$) of the sodium silicate solution as received from the supplier, and 0.010 g (0.02 mmol) Dequest 2041 (100% basis) are added and the pH is adjusted at 10.0 at 40° C. with 4N $H_2SO_4$.

Two 50 ml samples are taken every 5 min. and titrated for total active oxygen [O] and peracetic acid [PAA] content.

The $(IF)_{SST}$ is defined as:

$$(IF)_{SST} = \frac{[O]_{t12} - [O]_{t30}}{[PAA]_{t12}} \times \frac{100}{t30 - t12}$$

$[O]_{t12}$ and $[O]_{t30}$ are the concentrations of active oxygen at 12 and 30 min, respectively, after the start of the test.

$[PAA]_{t12}$ is the PAA concentration at 12 min after the start of the test or 2 min after the pH adjustment to 10.0.

STP=sodium triphosphate.

Dequest 2041=Ethylene diamine tetra methylene phosphonic acid.

TAED=N,N,N',N'-tetra acetyl ethylene diamine.

A correlation between the sodium silicate Instability Factor and the concentration of Ti(IV) delivered by the silicate in the standard test is shown in the annexed Figure. Generally, silicates having $IF_{SST}>3$ should be avoided. Preferred silicates are those having $IF_{SST}\leqq 2$, more preferably $IF_{SST}\leqq 1$.

EXAMPLES I-II

Conventional ternary active low temperature bleach detergent powder formulations, comprising silicate, sodium perborate (15%), tetra acetyl ethylene diamine (2%) and ethylene diamine tetra methylene phosphonic acid (0.3%), were used in these tests.

Formula I contained 6 mg/kg=6 ppm Ti(IV)

Formula II contained 9 mg/kg=9 ppm Ti(IV)

Formula A contained 43 mg/kg=43 ppm Ti(IV).

The Instability Factors (IF) as determined by the standard test under heat-up conditions from 20°-60° C. are shown in Table 1 below:

TABLE 1

| German Hardness of water: | 0° | | 15° | |
|---|---|---|---|---|
| Initial pH: | 10.0 | 10.7 | 10.0 | 10.7 |
| IF Formula I | 1.1 | 0.8 | 1.3 | 3.6 |
| IF Formula II | — | — | 1.9 | 5.0* |
| IF Formula A | 1.9 | 2.7 | 5.8 | 13.4 |

*at pH 10.5

The above Table clearly shows the pH and water hardness dependency of the effect of Ti(IV) on peracid stability. It also shows a consistent decrease in Instability Factor with decreasing Ti(IV) content, indicating a better peracid stability. Formula A is totally unsatisfactory in water of 15° GH, especially at pH 10.7.

EXAMPLES III-VII

Conventional ternary active low temperature bleach detergent powder formulations, comprising silicate, EDTA (0.2%), sodium perborate (15%), tetra acetyl ethylene diamine (2%) and ethylene diamine tetra phosphonic acid (0.3%) were used in the tests.

| Formula | III-VI | VII |
|---|---|---|
| Sodium alkyl benzene sulphonate | 6.2 | 7.8 |
| Nonionic surfactant | 2.9 | 3.9 |
| Sodium soap | 4.9 | 4.4 |
| Sodium triphosphate | 32.9 | 33.5 |
| Alkaline silicate | 5.7 | 9.0 |
| Sodium sulphate | 20.7 | 10.5 |
| Magnesium silicate | — | 1.1 |
| Sodium carboxy methyl cellulose | — | 0.7 |
| EDTA | 0.2 | 0.2 |
| TAED | 2.0 | 2.0 |
| Sodium perborate | 15.0 | 15.0 |
| EDTMP | 0.3 | 0.3 |

-continued

| Formula | III-VI | VII |
|---|---|---|
| Water and minor ingredients | up to 100 | |

Formula III contains 0.7 ppm Ti(IV)
Formula IV contains 2.0 ppm Ti(IV)
Formula V contains 3.0 ppm Ti(IV)
Formula VI contains 5.0 ppm Ti(IV)
Formula VII contains 15.8 ppm Ti(IV)

The Instability Factors (IF) as determined by the standard test under heat-up conditions from 20°-60° C. at initial pH=10.0, as well as the bleaching effects on tea-stained test cloths are shown in Table 2.

TABLE 2

| Water hardness | III | IV | V | VI | VII | |
|---|---|---|---|---|---|---|
| 8° GH | 0.4 | 0.4 | 0.4 | 1.0 | 1.0 | (IF) |
| | 20.5 | 20.5 | 20.6 | 20.4 | 19.1 | (ΔR) |
| 15° GH | 0.4 | 0.5 | 0.8 | 1.0 | 2.4 | (IF) |
| | 20.4 | 20.4 | 20.5 | 19.6 | 19.0 | (ΔR) |
| 22° GH | 0.9 | 1.2 | 1.7 | 3.4 | 5.5 | (IF) |
| | 20.5 | 19.7 | 19.8 | 18.8 | 17.1 | (ΔR) |
| 29° GH | 1.6 | 3.1 | 4.8 | 6.1 | 8.0 | (IF) |
| | 19.0 | 19.2 | 18.3 | 18.0 | 15.0 | (ΔR) |

EXAMPLES VIII-X

The following sodium triphosphate built formulation and two high soap formulations were used in the test using different qualities of alkaline silicate having an $IF_{SST}$ varying from 0.2 to 1.7.

| Composition | VIII | IX | X |
|---|---|---|---|
| Soap | 5 | 40 | 35 |
| Sodium triphosphate | 32 | — | — |
| Nitrilo triacetic acid (NTA) | — | — | 5 |
| Alkyl benzene sulphonate | 6.5 | — | — |
| Nonionic surfactant | 3.0 | 3.0 | 3.0 |
| Alkaline silicate | 8.0 | 10.0 | 10.0 |
| Sodium sulphate | 16.0 | 18.0 | 18.0 |
| Mg silicate | 1.0 | 1.0 | 1.0 |
| Sodium carboxy methyl cellulose | 0.5 | 1.0 | 1.0 |
| EDTA | 0.15 | 0.15 | 0.15 |
| EHDP | — | 0.03 | 0.03 |
| Fluorescer | 0.26 | 0.26 | 0.26 |
| TAED | 2.0 | 2.0 | 2.0 |
| Sodium perborate | 15.0 | 15.0 | 15.0 |
| EDTMP | 0.3 | 0.3 | 0.3 |
| Water and minor ingredients | | up to 100 | |

EDTA = ethylene diamine tetra acetic acid
EHDP = ethane hydroxy-1,1-diphosphonic acid
EDTMP = ethylene diamine tetra methylene phosphonic acid The Instability Factors (IF) of the compositions in a 20°-60° C. heat-up test under various water hardness conditions are shown in Table 3.

TABLE 3

| Na silicate ($IF_{SST}$) | Water hardness (° GH) | VIII (IF) | IX (IF) | X (IF) |
|---|---|---|---|---|
| 0.2 | 28 | — | 1.9 | — |
| 0.3 | 0 | — | 0.5 | 3.5 |
| | 11 | — | 1.8 | 2.4 |
| | 22 | — | 1.9 | 2.2 |
| | 25 | — | — | 1.9 |
| | 28 | — | 1.7 | 2.1 |
| 0.4 | 15 | 0.5 | — | — |
| 0.5 | 11 | — | 2.4 | — |
| 1.2 | 11 | — | — | 3.5 |
| | 28 | — | 5.3 | — |
| 1.7 | 0 | 1.2 | 1.2 | — |
| | 11 | 1.6 | 7.1 | 4.6 |

TABLE 3-continued

| Na silicate ($IF_{SST}$) | Water hardness (° GH) | VIII (IF) | IX (IF) | X (IF) |
|---|---|---|---|---|
| | 28 | — | 7.6 | 7.3 |

The above results clearly show the particular importance of silicate quality for the stability of low temperature bleach systems in high soap formulations. Only very good quality silicates having $IF_{SST} \leqq 1$ will guarantee such low levels of Ti(IV) in the compositions so as to produce a really satisfactory product with respect to peracid stability and bleach efficiency.

EXAMPLE XI

This example shows a zeolite-built low temperature bleaching detergent composition having titanium (IV) contents within the scope of the invention.

| Composition | $XI_1$ | $XI_2$ | $XI_3$ |
|---|---|---|---|
| Sodium alkyl benzene sulphonate | 6.5 | 6.5 | 6.5 |
| Nonionic surfactant | 3.0 | 3.0 | 6.5 |
| Sodium soap | 5.0 | 5.0 | 5.0 |
| Alumino silicate (Zeolite A) | 40.0 | 40.0 | 40.0 |
| Alkaline silicate | 8.0 | 8.0 | 8.0 |
| Sodium sulphate | 15.7 | 15.7 | 15.7 |
| EDTA | 0.15 | 0.15 | 0.15 |
| Sodium carboxy methyl cellulose | 0.5 | 0.5 | 0.5 |
| Fluorescer | 0.3 | 0.3 | 0.3 |
| TAED | 2.5 | 2.5 | 2.5 |
| Sodium perborate | 8.0 | 8.0 | 8.0 |
| Water and minor ingredients | | up to 100 | |
| Ti(IV) content (mg/kg) | 8.2 | 4.0 | 1.0 |

The bleaching results on standard tea-stained test cloths, calculated as reflectance $\Delta R_{460^*}$, in a heat-up washing test from 20°–60° C. in 25 minutes and maintaining the temperature at 60° C. for 30 minutes using water of 15° GH (Ca:Mg=4:1 molar) are:

| | |
|---|---|
| Composition $XI_1$ | $\Delta R_{460^*} = 11.5$ |
| Composition $XI_2$ | $\Delta R_{460^*} = 14.6$ |
| Composition $XI_3$ | $\Delta R_{460^*} = 17.0$ |

The consistent improvement in bleaching effect resulting from the improvement in peracid stability on decreasing the Ti(IV) content is clearly shown.

We claim:

1. Low temperature bleaching detergent compositions comprising about 3–30% by weight of a silicate, 2–35% by weight of an inorganic per-salt, 0.25 to 20% by weight of an organic peracid precursor and less than 10 mg/kg of reactive titanium (IV), based on the total weight of the composition.

2. Detergent compositions according to claim 1, which comprise not more than 5 mg/kg of reactive titanium (IV).

3. Detergent compositions according to claim 1, which comprise a silicate, selected from alkalimetal silicates, magnesium silicate and aluminosilicates and mixtures thereof.

4. Detergent compositions according to claim 1, which comprise a surfactant selected from the group consisting of anionic soap or non-soap detergents, nonionic, cationic, semi-polar, ampholytic and zwitterionic detergents and mixtures thereof at a level of from 0.1% to 60% by weight.

5. Detergent compositions according to claim 4, which comprise from 15% to 50% by weight of soap.

6. Detergent compositions according to claim 5, which comprise not more than 3 mg/kg of reactive titanium (IV), based on the total weight of the composition.

7. Low temperature bleaching detergent compositions comprising about 3–30% of a silicate, 2–35% by weight of an organic peracid and less than 10 mg/kg of reactive titanium (IV), based on the total weight of the composition.

8. Detergent compositions according to claim 1, which comprise an organic peracid in lieu of said inorganic persalt/organic peracid precursor system.

9. Detergent compositions according to claim 7, which comprise not more than 5 mg/kg of reactive titanium (IV).

10. Detergent compositions according to claim 7, which comprise a silicate, selected from alkalimetal silicates, magnesium silicate and aluminosilicates and mixtures thereof.

11. Detergent compositions according to claim 7, which comprise a surfactant selected from the group consisting of anionic soap or non-soap detergents, nonionic, cationic, semi-polar, ampholytic and zwitterionic detergents and mixtures thereof at a level of from 0.1% to 60% by weight.

12. Detergent compositions according to claim 11, which comprise from 15% to 50% by weight of soap.

13. Detergent compositions according to claim 12, which comprise not more than 3 mg/kg of reactive titanium (IV), based on the total weight of the composition.

* * * * *